US006755002B2

(12) United States Patent
Pendrous et al.

(10) Patent No.: US 6,755,002 B2
(45) Date of Patent: Jun. 29, 2004

(54) APPARATUS AND METHOD FOR REPAIRING POPPED WALLBOARD NAILS

(76) Inventors: Nicholas M. Pendrous, 22 Villanova Dr., Kendall Park, NJ (US) 08824; Thomas O. Wiener, 66 Frost Ave., East Brunswick, NJ (US) 08816

( * ) Notice: Subject to any disclaimer, the term of this patent is extended or adjusted under 35 U.S.C. 154(b) by 175 days.

(21) Appl. No.: 10/012,883

(22) Filed: Oct. 24, 2001

(65) Prior Publication Data

US 2003/0074847 A1 Apr. 24, 2003

(51) Int. Cl.[7] ..... E02D 37/00

(52) U.S. Cl. ..... 52/514; 52/DIG. 1; 52/749.1; 52/741.1; 81/52; 227/107; 227/147

(58) Field of Search ..... 52/514, 514.5, 52/741.1, 741.13, 741.15, 745.21, 750, 749.1, DIG. 1; 81/463, 488, 44, 53.2, 429, 28; 227/107, 147, 140

(56) References Cited

U.S. PATENT DOCUMENTS

| | | | | | |
|---|---|---|---|---|---|
| 3,982,678 | A | * | 9/1976 | Olson | 227/63 |
| 4,041,558 | A | * | 8/1977 | Victor | 7/158 |
| 4,367,836 | A | | 1/1983 | Hodson | 227/142 |
| 4,384,622 | A | * | 5/1983 | Koziniak | 173/205 |
| 4,610,381 | A | | 9/1986 | Kramer et al. | |
| 4,611,964 | A | | 9/1986 | Schlein | 411/356 |
| 4,676,424 | A | | 6/1987 | Meador et al. | 227/147 |
| 4,811,883 | A | * | 3/1989 | Thurner et al. | 227/10 |
| 4,867,366 | A | * | 9/1989 | Kleinholz | 227/66 |
| 5,546,625 | A | * | 8/1996 | Mealey, Sr. | 15/105 |
| 5,555,691 | A | | 9/1996 | Nguyen | |
| 5,749,113 | A | | 5/1998 | Witter | 7/166 |
| 5,890,860 | A | | 4/1999 | Dorris | |
| 5,987,846 | A | * | 11/1999 | Nahas | 52/733.3 |
| 6,088,986 | A | | 7/2000 | DiGate | 52/514 |
| 6,106,916 | A | * | 8/2000 | Lukowski, Sr. | 428/40.1 |
| 6,116,834 | A | | 9/2000 | Dorris | 411/404 |
| 6,247,283 | B1 | * | 6/2001 | Slabaugh et al. | 52/514 |
| 6,347,496 | B1 | * | 2/2002 | Pinkins | 52/514 |

OTHER PUBLICATIONS

Shear Values for Screw Application of Gypsum Board on Walls—Gypsum Association Copyright 1996.
Application and Finishing of Gypsum Board (GA–216–2000) Gypsum Association Copyright Feb. 2000.

* cited by examiner

*Primary Examiner*—Jeanette Chapman
(74) *Attorney, Agent, or Firm*—Walter J. Tencza, Jr.

(57) ABSTRACT

An apparatus and a method for repairing nail pops in a wallboard is disclosed. The apparatus can be placed In a first state in which it acts as a cutting tool and can be used to cut a bore hole into a wallboard to separate a popped nail from the wallboard. The apparatus can also be placed in a second state in which it acts as a driving or impact tool and can be used to drive the popped nail which has been separated from the wallboard, into a framing support. The apparatus may be comprised of first and connecting members and a cutting member. The driving member may have an elongated core and may be connected by the connecting member to the cutting member. The driving member may be able to slide with respect to the connecting member to allow the apparatus to change from the first state to the second state.

20 Claims, 9 Drawing Sheets

10
20
20a
20b
24
24b
32
34a
34b
34c
34d
36
38
38b
100
100a
100b
102
104
106
116
200
200a
200b
212
214
38a
202
300
302
310
312a
320
D5
D6

APPARATUS AND METHOD FOR REPAIRING POPPED WALLBOARD NAILS

FIELD OF THE INVENTION

This invention relates to improved methods and apparatus concerning popped wallboard, sheetrock or drywall nails.

BACKGROUND OF THE INVENTION

Wallboard, also known as drywall, plasterboard, sheet rock and gypsum board, is a rigid board used to create interior walls for many if not most modern structures. Wallboard is typically made of layers of fiberboard or paper bonded to a gypsum plaster core. Wallboard is used instead of plaster or wood panels to form walls.

Wallboard is mounted to structural framing using a variety of fastening methods and fastener types. Present-day wallboard installers typically use nails or screws to fasten wallboard to underlying framing supports. The most widely used material of framing support is the wooden stud.

Drywall nails can be used to fasten wallboards to framing supports. Typically, the head of a drywall nail is flat and a sheet rock hammer with a convex face is used for driving the nail into framing supports. The hammer face is convex so that the paper on the wallboard around the head of the nail when driven home will not be broken by the hammer. Also, the convex hammer face creates the depth and expanse of a dimple in the drywall for receiving the appropriate fill. When the nail is properly driven through the drywall and into the stud, the convex face of the hammer drives the nail head, which catches the paper, securing it inside the dimple, created by the hammer. When properly performed, the next step is to fill the dimple with the drywall mud compound (herein after "compound") covering the nail until the compound in the dimple lies flush with the surface of the drywall. It will be appreciated that the head of the drywall nail resides at the bottom of the dimple and its role is to hold the stretched surface paper of the drywall tightly to the smashed gypsum under the paper of the dimple, securing the paper to the drywall and the drywall to the stud.

Instead of drywall nails, multi-purpose screws can be used to fasten wallboard to studs or other framing supports. Typically such multi-purpose screws have a flat head. Each screw must be recessed beneath the surface of the facing paper leaving a sufficient dimple for the drywall mud; similar to the procedures outlined above for drywall nails.

There has been a trend towards using screws rather than nails over the last several years. Screw heads are larger than nail heads, providing a greater bearing surface to support the wallboard. Additionally, the threaded shank of screw, even though normally shorter than a nail shank, provides greater holding power than a nail. Industry studies by the Gypsum Association have confirmed the greater shear resistance of screws versus nails in gypsum wallboard application. This association recommends in its current application specifications that nails be more closely spaced during installation. Since screw based applications require fewer fasteners this allows for faster application.

Nail pops (also known by some as "poppers") occur when the wallboard fastener (such as the nail or screw), and portion of the drywall mud covering it, juts out past the plane of the wallboard facing paper forming an unsightly convex bulge. In extreme cases where the drywall mud is stressed to the point of losing its structural integrity it may separate from the wall exposing the wallboard fastener head.

Nail pops can occur immediately after installation, although generally they occur several weeks to several years after the wallboard has been installed. Immediate problems exist due to poor installation, typically when the installer does not drive the fastener sufficiently deeply into the wallboard. The drywall mud, without a dimple of sufficient depth to fill, cannot cover the fastener head while remaining flush with the wall face. The installer prior to a wall being primed and painted typically attempts to remedy problems that are immediately apparent using the current methods which will be described below.

More typically nail pops appear on what was once a perfect wall facing. This occurs either because the drywall has moved and the fastener stayed still, or the fastener moved and the drywall stayed still, or a combination of the two. Most often this is caused with wooden studs shrinking as they dry. During shipment, storage and construction, wood framing is exposed to the natural elements. Wood is a natural material with a cellular disposition to absorb moisture and expand. It is in this moisture laden and expanded state when wallboard is fastened onto it. Once protected by a weather-tight shield and subjected to a heating cycle the wood dries and shrinks. When first fastened, wallboard should mount tightly against the stud (If this is not the case then the problem detailed here is exacerbated). But as the wood between the fastener tip, whose position is fixed, and the edge of the stud shrinks, it pulls away from the back of the panel, leaving a small gap between the framing and the stud. Pressure excerpted against the wall surface by day to day contact is then only restricted by the nail head and filling compound. To exacerbate the scenario above, wood shrinking can also squeeze fasteners out of a stud. Since wood is a natural substance with uneven physical properties and drywall installation is a manual task, variances in fastener integrity can occur. A weak fastener may thus be squeezed out against otherwise secure drywall resulting in a nail pop.

While both nails and screws can become nail pops, the increased shear resistances of screws make them less prone. This is a further reason why use of the screw as a fastener has become more widespread. Improvements to the multi-purpose screw have also been proposed-for example in U.S. Pat. Nos. 6,116,834 and 5,890,860, both to Dorris.

Using nails to secure wallboard to studs was common practice for years and today wallboard nails are still sold for this purpose. Nail pops are a problem for property owners with nail secured wallboard currently and for those that will own properties with nail secured wallboard built in the future.

The best solution for a nail pop is to remove the fastener from the wall. Nails cannot be simply removed from wallboard by traditional methods such as the claw of a hammer of fulcrum type cats paw. These methods are too aggressive for the fragile wallboard. The use of these tools can harm the facing paper and gypsum core causing catastrophic structural damage to the wallboard. Since there is no traditional method for removing the fastener from the wallboard other methods of repair have been employed.

One common practice for repair is to hit the bulging compound or popped nail with a hammer. A variation to this practice is to reset the nail using a traditional nail punch. The nail punch acts as an intermediary between an impact tool and a nail head. Once the nail is reset, compound is applied over the area for aesthetic purposes and the area is repainted or otherwise decorated.

In practice, this method does not address the original cause of failure. The nail is susceptible to pop for many of the same reasons it did the first time. Additionally, since a nail gains its strength via friction, reseating a nail in a hole it previously occupied subjects it to less frictional force. This makes it weaker than it was initially. Finally, since the impact tool's striking surface is larger than the nail head, when striking the nail head, the impact tool damages the brittle wallboard surrounding the nail. This debilitates the integrity of the wallboard. When used expertly, the nail punch focuses the impact tool energy on the nail head reducing some of this effect. In the hands of novice a poorly directed punch can miss the nail head, driving a damaging punch into the brittle wallboard around the nail head.

A second practice employed drives a second nail into the stud with adjacent placement of the second nail head to cover a fractional portion of the first. This method has limitations since the second nail, by design, is as likely to pop as the first if the wallboard is not secure. Further, positioning the second nail over the first nail necessitates driving the first nail deeper into the wallboard to ensure the second nail has a sufficient dimple to fill. Such impact breaks the facing paper and shatters the brittle wallboard surrounding the nail debilitating the integrity of the wallboard.

The third current practice involves driving a wallboard screw into the stud adjacent to the nail. The purpose of the screw is to secure the wallboard. In a variation of this method, two screws are used. The screw(s) do not contact the nail. The nail is repositioned below the plane of the facing paper with a hammer. Compound is applied over the area for aesthetic purposes and the area is repainted or otherwise decorated. This method is effective in securing the wallboard only and does not secure the nail. If the nail was squeezed out due to shrinkage there is nothing to stop this happening again if the wood shrinks further. Additionally, since a nail gains its strength via friction, reseating a nail in a hole it previously occupied subjects it to less frictional force making it weaker than it was initially. Finally, this impact further shatters the brittle wallboard surrounding the nail debilitating the integrity of the wallboard.

The fourth and the only permanent practice is to tear out the existing drywall, replace and secure new wallboard with drywall screws. This is a labor intensive, costly, time consuming, and messy job.

SUMMARY OF THE INVENTION

The present invention in one or more embodiments provides an apparatus and a method designed for the purpose of repairing nail pops in a wallboard. An impact driven wallboard cutting tool is disclosed, which is designed to create a bore around a fastener head. A protective shield for placing in a delicate wallboard bore is disclosed for minimizing damage when a driving force removes a fastener from the wallboard.

An apparatus and method for repairing nail pops in wallboard is disclosed. The apparatus may be an impact driven, wallboard cutting and nail driving tool, which may be comprised of an elongated core having a bottom end for contacting a nail head or work piece and an upper end for receiving the impact of an impact tool, such as a hammer. The bottom end may include a forward facing cutting edge. A driving surface may be recessed within a cutting member. A method in accordance with an embodiment of the present invention may include a sequence of separating wallboard from nail then wallboard from stud.

It is an object of the present invention to eliminate the need for a popped wallboard fastener to be reseated in its original position.

It is a further object of the present invention to separate the fastener from the wallboard without the need for a potentially destructive leverage tool such as a hammer claw.

It is a further object of the present invention to eliminate the need for the broad striking face of an impact tool which may compress and shatter brittle wallboard.

It is a further object of the present invention to eliminate the risk of an impact tool driving a nail too deep into the wallboard, piercing the facing paper.

It is a further object of the present invention to eliminate the risk of an inaccurate nail punch missing the fastener and puncturing the wallboard.

It is a further object of the present invention to remove all broad, blunt impacts to brittle wallboard.

It is yet another object of the present invention to permanently remove the fastener from the wallboard.

It is yet another object of the present invention to provide a consistent bore for standard and predictable repair.

It is yet another object of the present invention to mitigate risk of having an impact driver miss a fastener head.

It is yet another object of the present invention to ensure a consistently sharp cutting edge by allowing for easy cutting member replacement.

Still further objects and advantages will become apparent from a consideration of the ensuing description and drawings.

The present invention in one or more embodiments discloses an apparatus comprising: a driving member, a connecting member, and a cutting member. The driving member may be comprised of an elongated core having a first end for receiving the impact of a driving tool and a second end, opposing the first end, for contacting a head of a fastener, such as a nail. The driving member may be thought of as a driving device. The cutting member may be comprised of a first end having a sharp edge for cutting. The connecting member may be used to connect the driving member and the cutting member. In some embodiments one or more of the first and connecting members and the cutting member may actually be integrated together or be portions of one member or one device.

In one embodiment of the present invention the apparatus can be placed in a cutting state wherein the second end of the driving member or driving device is recessed within the cutting member. In the cutting or first state the apparatus can be used as a cutting tool. In a method of an embodiment of the present invention, the apparatus in the first state can be used to cut a bore hole into a wallboard around a nail which has been driven into the wallboard. The bore hole can be cut by hitting the apparatus in the first state with a hammer, or in other ways, such as by using rotation to cut the bore hole, in a drill like manner. The apparatus can also be placed in a driving or second state wherein the second end of the driving member extends outward from the cutting member so that the apparatus can be used to drive a nail into a framing support.

The connecting member may have a cylindrical hole into which the elongated core of the driving member can be inserted. The driving member may be comprised of a substantially flat portion connected to the elongated core. The connecting member may be comprised of a first portion and a second portion and a gap between the first and second portions. In the first state, or cutting state, the substantially flat portion of the driving member may lie outside of the gap of the connecting member; and in the second state or driving state the substantially flat portion of the driving member may lie within the gap of the connecting member.

The elongated core of the driving member may be comprised of a first channel running a portion of the length of the elongated core. A first screw may be inserted into the first channel to connect the driving member to the connecting member, but to also allow the driving member to slide with respect to the connecting member. The elongated core of the driving member may also be comprised of a second channel running substantially perpendicularly to the first channel, and the first screw can slide into the second channel to permit the driving member to be rotated with respect to the connecting member.

The rotation of the driving member with respect to the connecting member can be important in ensuring the proper function of the tool. The second channel ensures the position of the substantially flat portion of the driving member is correctly aligned with the connecting member for both the cutting and the driving state. Other mechanisms can be used to achieve this alignment. For example, in a variation of the preferred embodiment a ball bearing and spring, similar to the common method of attaching a ratchet head to a ratchet handle, can ensure the members "click" into place and are held in the desired position.

In one embodiment of the present invention after a bore hole has been made in wallboard, separating a nail from the wallboard, the nail can be pulled out of a framing support, for example by needle nose pliers. In this embodiment, one does not need to drive the nail into the framing support.

The present invention discloses a method comprising the steps of finding a nail which has been nailed through a wallboard at a location and into a framing support but which has popped out so that a nail head of the nail lies substantially out of a plane of the wallboard, separating the nail from the wallboard so that the nail is no longer structurally connected to the wallboard, and driving the nail into the framing support.

The cutting member may be detachable from the first and/or connecting member so that a new cutting member can be provided when the cutting edge or cutting end of the cutting member is no longer sharp. Having the cutting member detachable is analogous to a razor having a disposable blade. A clean cutting edge or cutting end for the cutting member is important in the proper function of an apparatus in accordance with the present invention.

DETAILED DESCRIPTION OF THE DRAWINGS

Figures 1A, 1B, 1C, 1D:
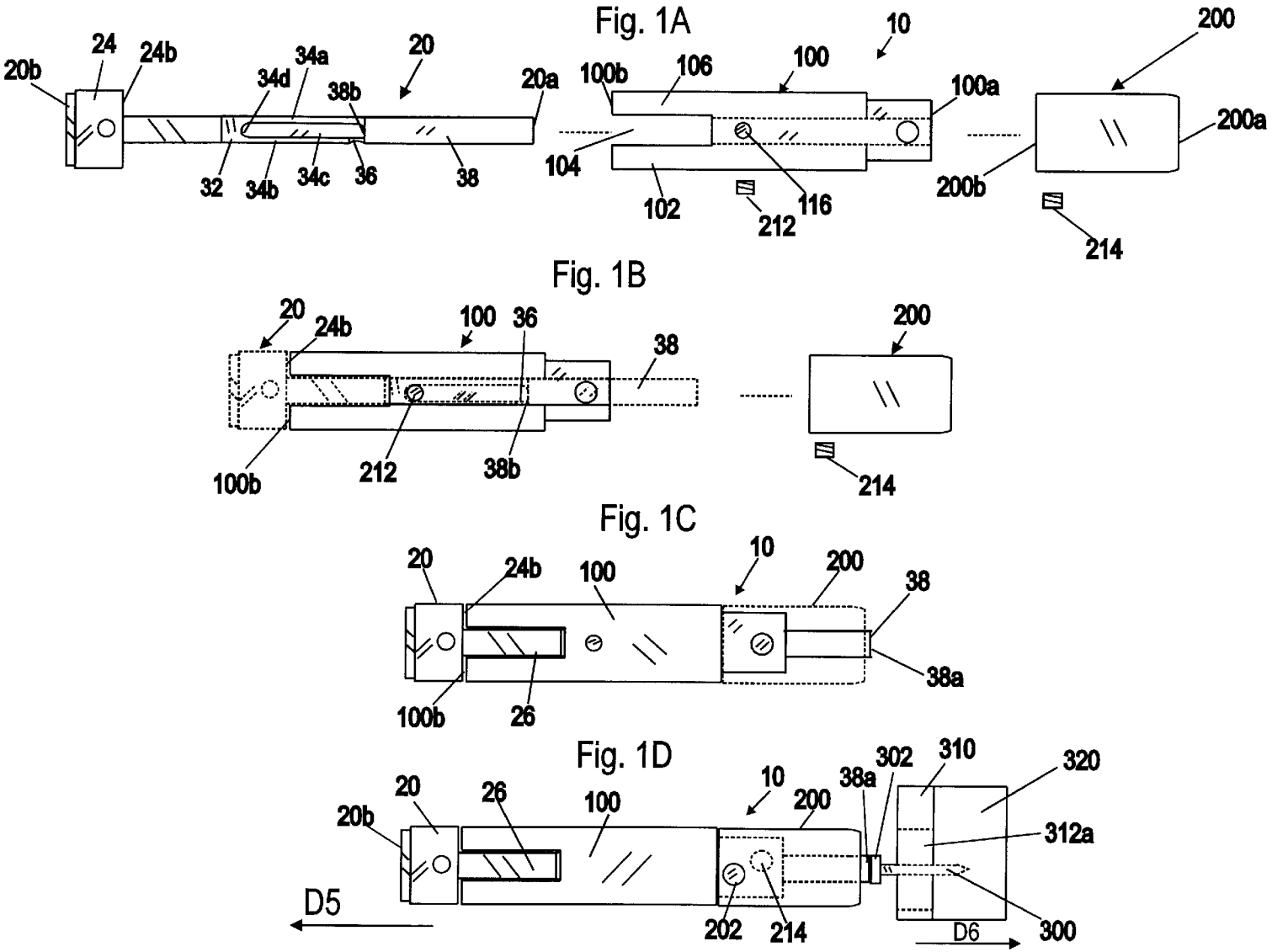
FIG. 1A shows a left side view of an apparatus comprised of first and connecting members and a cutting member, in accordance with a first embodiment of the present invention in a disassembled condition.
FIG. 1B shows a left side view of the apparatus of FIG. 1A in a partially assembled condition.
FIG. 1C shows a left side view of the apparatus of FIG. 1A in a completely assembled condition and in a driving state.
FIG. 1D shows a right side view of the apparatus of FIG. 1A in a completely assembled condition and in a first translational position of the driving state.

FIG. 1A shows a left side view of an apparatus 10 comprised of driving member 20, a connecting member 100 and a cutting member 200, and screws 212 and 214 in accordance with a first embodiment of the present invention in a disassembled condition.

FIGS. 3A–3F show bottom, left side, top, right side, rear, and front views of the driving member 20 of FIG. 1A. The driving member 20 includes a cylindrical portion 22, a cylindrical portion 24, a substantially flat portion 26, and a portion 30. Portion 30 may be considered to be an elongated core. The elongated core 30 or portion 30 or in fact the entire apparatus 10 or substantially the entire apparatus 10 may be made of a material such as a metal, wood, a synthetic material, or a composite material, which should be a hard, rigid material. The driving member 20 has a rear end 20*b* shown in FIG. 1A and a front end 20*a* shown in FIG. 1A. The driving member 20, the portion 30 and/or the portion 38 may be considered separately or together a driving device or a driving member for driving or impacting a nail.

The cylindrical portion 24 has a cylindrical opening 25 running through it from an end 25*a* to an end 25*b* as shown in FIGS. 3A–3D. The cylindrical portion 24 has a rear end 24*a* and a front end 24*b* shown in FIG. 3B. The substantially flat portion 26 has a left flat surface 26*a* shown in FIG. 3A and a right flat surface 26*b* shown in FIG. 3B.

Figure 3A:
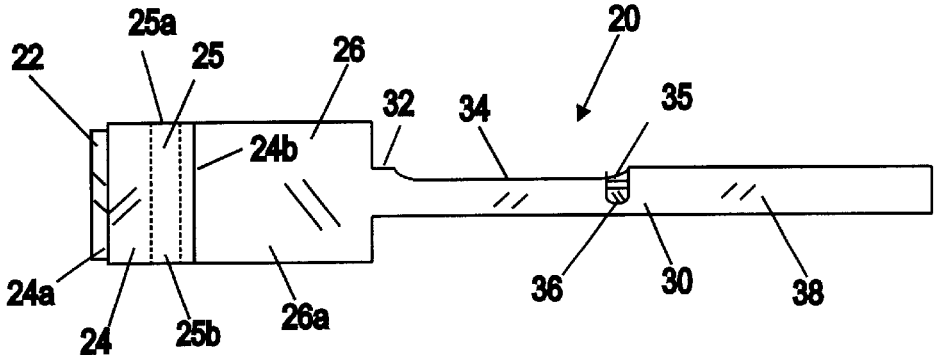
FIG. 3A shows a bottom view of the driving member of FIG. 1A.
Figure 3B:
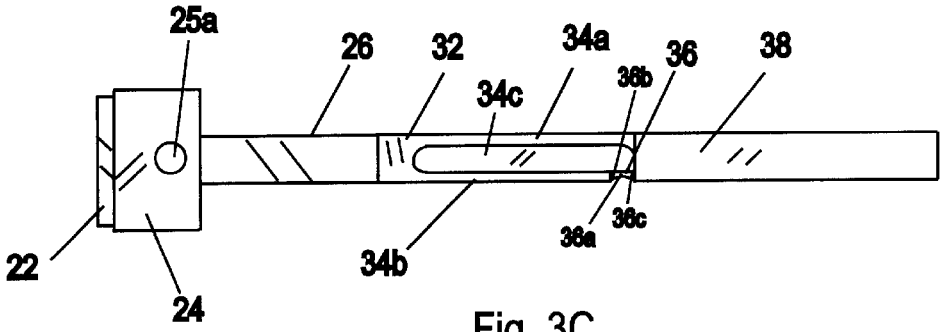
FIG. 3B shows a left side view of the driving member of FIG. 1A.
Figure 3C:
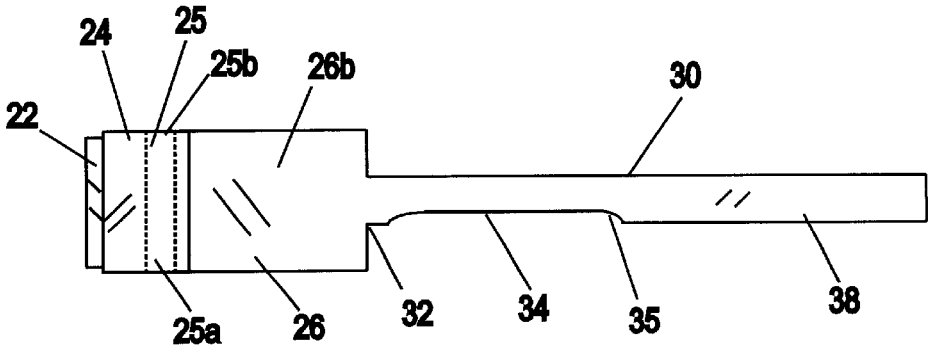
FIG. 3C shows a top view of the driving member of FIG. 1A.
Figure 3D:
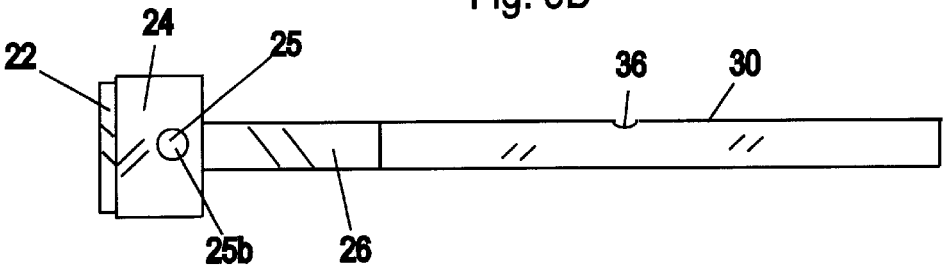
FIG. 3D shows a right side view of the driving member of FIG. 1A.
Figure 3E:
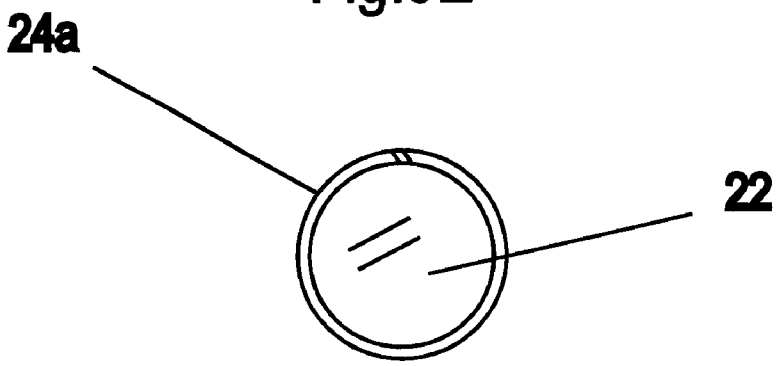
FIG. 3E shows a rear view of the driving member of FIG. 1A.
Figure 3F:
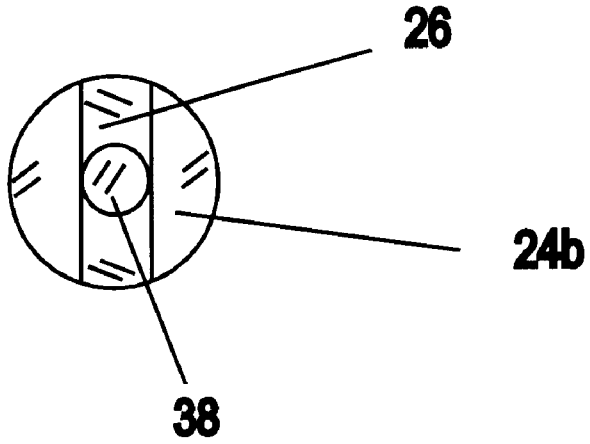
FIG. 3F shows a front view of the driving member of FIG. 1A.
Figure 4A:
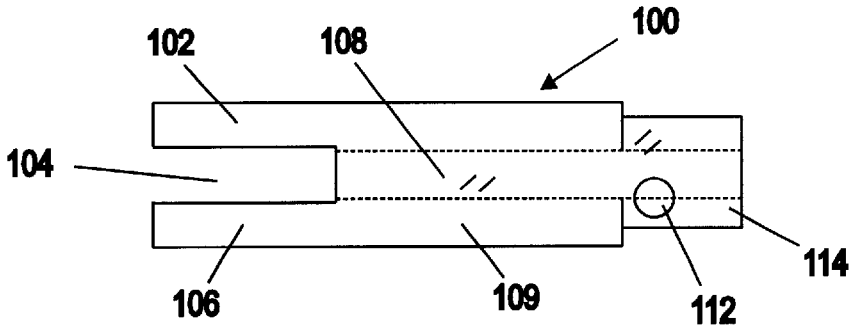
FIG. 4A shows a right side view of the connecting member of FIG. 1A.
Figure 4B:
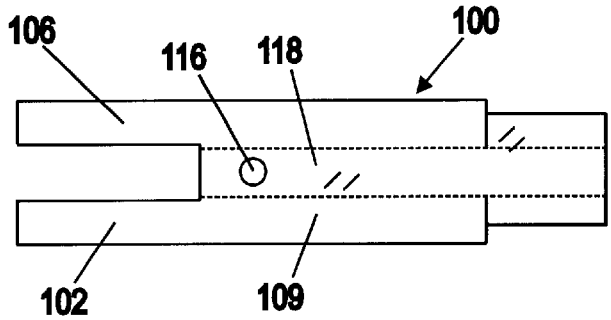
FIG. 4B shows a left side view of the connecting member of FIG. 1A.
Figure 4C:
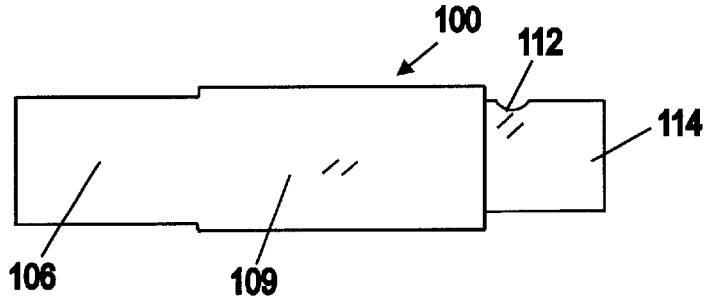
FIG. 4C shows a top view of the connecting member of FIG. 1A.
Figure 4D:
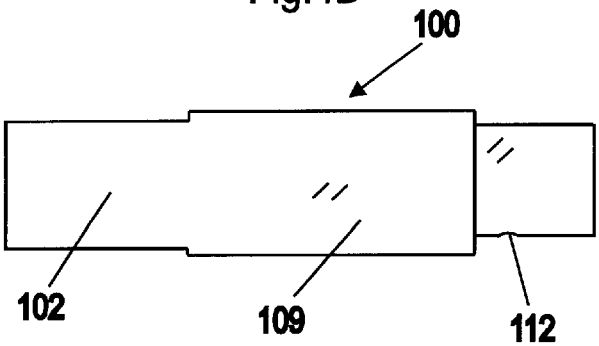
FIG. 4D shows a bottom view of the connecting member of FIG. 1A.
Figure 4E:
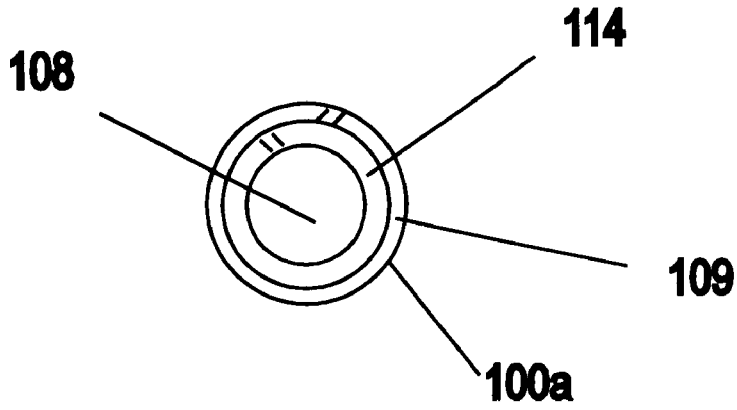
FIG. 4E shows a front view of the connecting member of FIG. 1A.
Figure 4F:
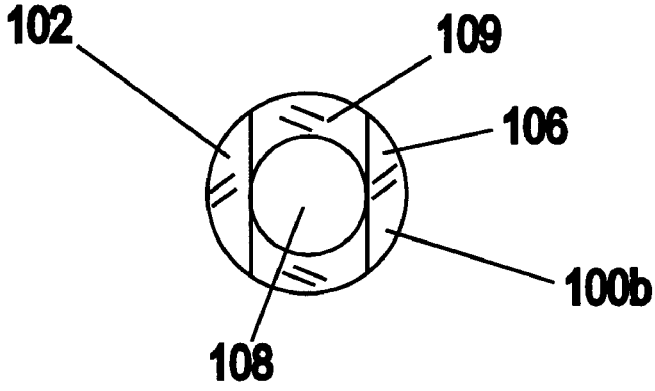
FIG. 4F shows a rear view of the connecting member of FIG. 1A.
Figure 5A:
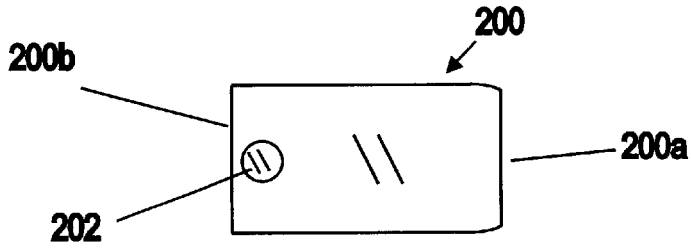
FIG. 5A shows a right side view of the cutting member of FIG. 1A.
Figure 5B:
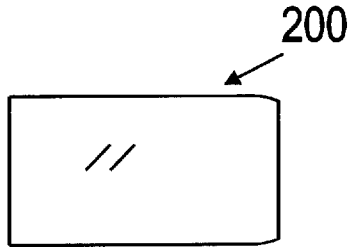
FIG. 5B shows a left side view of the cutting member of FIG. 1A.
Figure 5C:
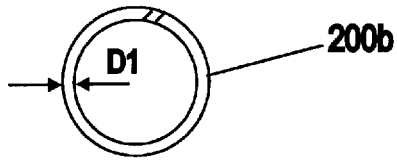
FIG. 5C shows a rear view of the cutting member of FIG. 1A.
Figure 5D:
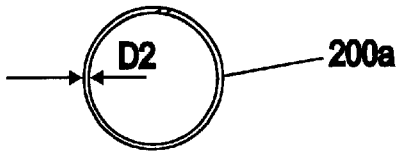
FIG. 5D shows a front view of the cutting member of FIG. 1A.

The portion 30 has a cylindrical portion 38 and is otherwise a cylinder which has been cut into to form various channels for a screw to be inserted into. The portion 30 includes a channel 34 running along a portion of the length of portion 30 as shown in FIGS. 3A, 3B, and 3C and a channel 36 running along a portion of the circumference of the portion 30 as shown in FIGS. 3A, 3B, and 3D. The channel 34 has a trench or indentation 34*c* which is bordered by a portion 32, a ridge 34*c*, a ridge 34*b*, a portion 35, and channel 36. The channel 36 is bordered by channel 34, and ridges 36*a*, 36*b*, and 36*c* shown in FIG. 3B.

FIGS. 4A–4F show right side, left side, top, bottom, front, and rear view of the connecting member 100 of FIG. 1A. The connecting member 100 includes portion 102, gap 104, portion 106, cylindrical opening 108, portion 109, openings 112 and 116, and portion 114. The openings 112 and 116 may be threaded for the insertion of a screw or nut. The connecting member 100 has a rear end 100*b* and a front end 100*a* shown in FIG. 1A.

FIGS. 5A–5D show right side, left side, rear, and front views of the cutting member 200 of FIG. 1A. The cutting member 200 is substantially a hollow cylinder having an opening 202. The cutting member 200 has a rear end or rear wall 200*b* and a front end or front wall 200*a*. The cutting member 200 may have a wall thickness D1 which may be one sixteenth (1/16) of an inch at its rear end 200*b* and a smaller wall thickness of D2 which may be one sixty-fourth (1/64) of an inch at its front end 200*a*. The thinner end 200*a* is used for cutting.

The assembly of the apparatus 10 of FIGS. 1A–1D will now be described. The driving member 20 is inserted into the connecting member 100 as shown by FIGS. 1A–1B. FIG. 1B shows the driving member 20 in dashed lines. The portion 38 of the driving member 20 is inserted into the gap 104 between portions 106 and 102 of the connecting member 100. The driving member 20 can be inserted into the connecting member 100 until the end 24*b* of the cylindrical portion 24 of the driving member 20 contacts the end 100*b* of the connecting member 100 as shown by FIG. 1B.

At the point where end 100*b* of the connecting member 100 contacts end 24*b*, the hole 116 in the connecting member 100 lines up with the end 34*d* of the channel 34 of the driving member 20. The screw 212 can be screwed into the hole 116 and through the hole 116 into the trench 34*c* of the channel 34. The screw 212 should be of a size and should be screwed in so that it lies in the trench 34*c* of the channel 34 but can slide along the channel 34. The screw 212, and ridges 34*a* and 34*b* of the channel 34 prevent the driving member 20 from substantially rotating with respect to the connecting member 100 except when the screw 212 reaches the channel 36. When an individual attempts to pull the driving member 20 out of the connecting member 100, the screw 212 contacts the portion 38 to prevent the driving member 20 from being disconnected from the connecting member 100.

After the driving member 20 has been connected to the connecting member 100 by the screw 212, the combination of these members can be connected to the cutting member 200. Alternatively, the connecting member 100 may be connected to the cutting member 200 and then that combination to the driving member 20. The cutting member 200 is connected to the connecting member 100 by screwing the screw 214 into and through the opening 202 of the cutting member 200, and into the opening 112 of the connecting member 100 as shown by referring to FIGS. 1D, 4A, and 5A. The cutting member 200 is then fixed to the connecting member 100 so that the cutting member 200 cannot be rotated or translated with respect to connecting member 100.

Figure 2A:
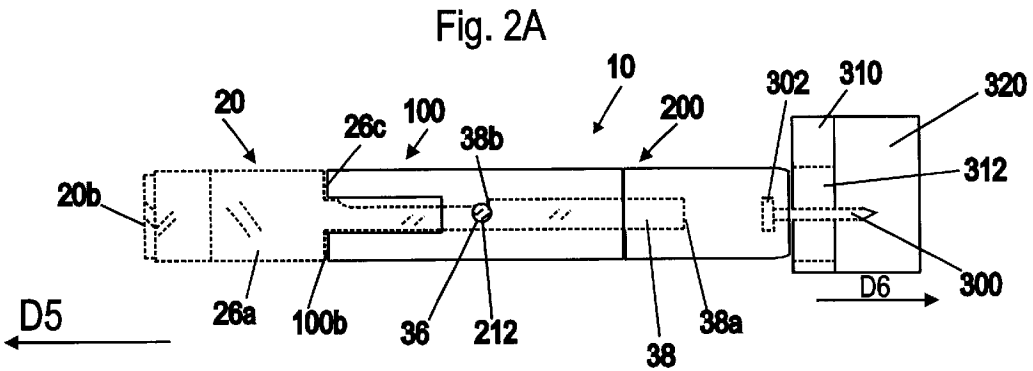
FIG. 2A shows a bottom view of the apparatus of FIG. 1C after the driving member has been pulled out of and rotated ninety degrees with respect to the connecting member of FIG. 1A into a cutting state, from the driving state shown in FIG. 1C and FIG. 2A also shows a nail driven into a wallboard and stud, which has popped out.

FIG. 2A shows apparatus 10 in a first or cutting state where portion 38 is recessed within cutting member 200. FIGS. 1C and 1D show the apparatus 10 in a driving or second state wherein an end 38*a* of the portion 38 extends outward from the cutting member 200. In this driving or second state the apparatus 10 can be used as a hammer or can be hit with a hammer to drive a nail. For example, if someone hits end 20*b* of the apparatus 10 in the state of FIGS. 1C and 1D then a nail can be driven with end 38*a* of the portion 38.

With the apparatus 10 now assembled as in FIGS. 1C and 1D, the apparatus can be placed in a first state shown in FIG. 2A wherein the apparatus 10 can be used as a cutting tool. This can be done by taking the apparatus 10 in the state of FIG. 1D, grabbing onto the portion 24 and pulling the driving member 20 so that is begins to move in the direction D5, while the connecting member 100 remains stationary. Because of the screw 212 which is inserted into the channel 34, the driving member 20 can move a certain distance in the direction D5, while the connecting member 100 remains stationary, but the driving member 20 will not become disconnected from the connecting member 100. The screw 212 eventually runs into or abuts end 38*b* of portion 38 and the screw 212 does not permit the driving member 20 to move any further in the direction D5. After the driving member 20 has been sufficiently slid in the direction D5 so that screw 212 abuts end 38*b*, the driving member 20 can now be rotated ninety degrees counterclockwise from the position and second state of FIG. 1C to the position and first state shown in FIG. 2A. When moving from the position in FIG. 1C to the position of FIG. 2A, the screw 212 slides out of channel 34 and into channel 36. Channel 36 has a ridge 36*a*, shown in FIG. 3B, which prevents the driving member 20 from being rotated further than ninety degrees.

In the cutting or first state of FIG. 2A, the substantially flat portion 26 of the driving member 20 lies outside the gap 104 of the connecting member 100. In contrast, in the second state of FIGS. 1C and 1D, the substantially flat portion 26 lies inside the gap 104 of the connecting member 100. In the first state of FIG. 2A, an end 26*c* of the portion 26 of the driving member 20 abuts against the end 100*b* of the connecting member 100. Unlike the second state of FIGS. 1C and 1D, the end 38*a* of the portion 38 does not extend outward from the cutting member 200 but rather lies within the cutting member 200.

Figure 1E:
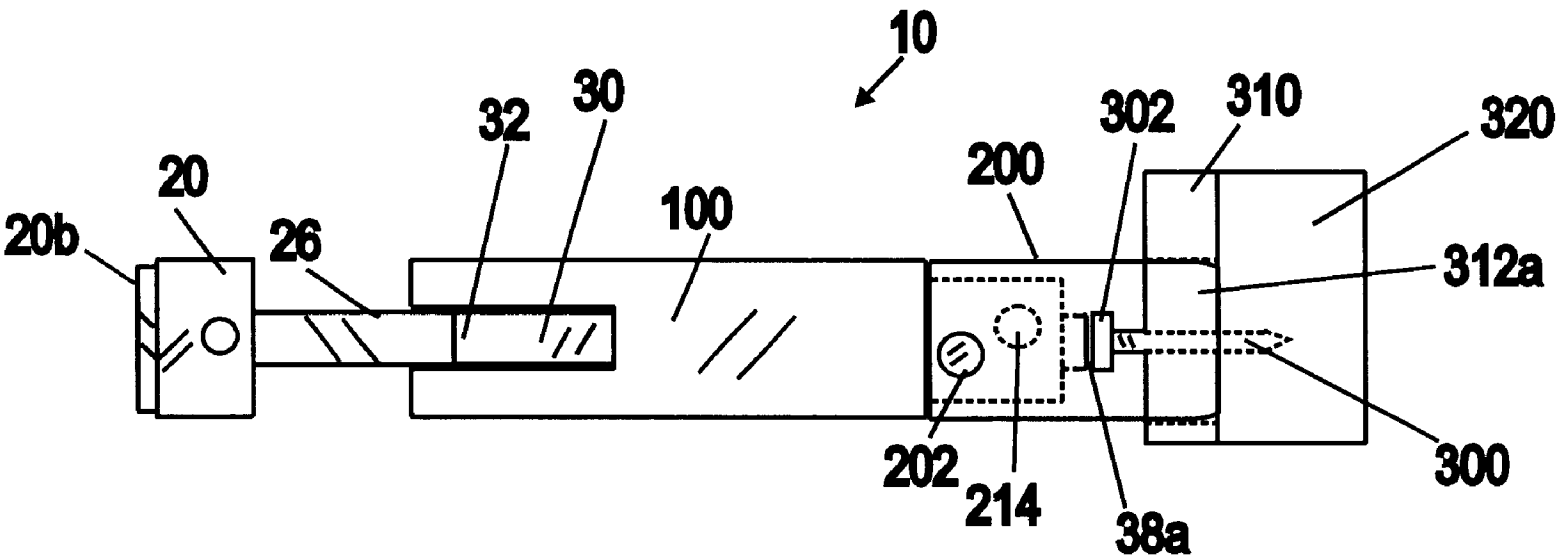
FIG. 1E shows a right side view of the apparatus of FIG. 1A in a completely assembled condition and in a second translational position of the driving state.

After the apparatus 10 is assembled, an individual can place the apparatus 10 in either the driving state and the transitional position of FIGS. 1C and 1D, or the driving state and transitional position shown in FIG. 1E (and many other transitional positions including transitional positions in between) or the cutting state of FIG. 2A. The apparatus 10 is placed in the driving state when an individual wants to use the apparatus 10 to drive a nail such as nail 300. In the driving state the portion 38 is not fixed with respect to the member 100 or the cutting member 200. FIGS. 1D and 1E show two possible translational positions of the portion 38 with respect to the member 100, which are both in the driving state. The hitting of the hammer on end 20*b* drives a nail by applying a force in the direction D6 shown in FIG. 1D through the driving member 20.

The apparatus 10 can be placed in the cutting state when an individual wants to use the apparatus 10 as a cutting tool. The apparatus 10 is changed from the state of FIGS. 1C and 1D into the state of FIG. 2A by pulling the driving member 20 (or optional handle 400 shown in FIGS. 6A and 6B) while the connecting member 100 remains stationary and then after the portion 26 is outside of the gap 104, rotating the driving member 20 counterclockwise ninety degrees to put the apparatus in the state of FIG. 2A. The end 20*b* can then be hit with a hammer to cause the end 200*a* of the member 200 to cut, for example, a circular hole in a piece of wallboard. Applying a force in the cutting state example, in the direction D6, shown in FIG. 2A, causes a force to be applied from end 20*b* and transmitted through driving member 20, connecting member 100 and cutting member 200.

Figure 2B:
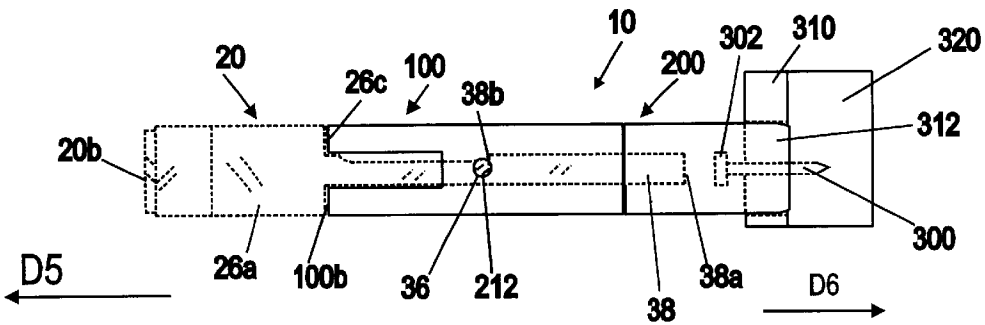
FIG. 2B shows a bottom view of the apparatus of FIG. 1C with the apparatus in the cutting state, after the apparatus has been hammered into the wallboard of FIG. 2A to cut a portion of the wallboard surrounding the nail out.

The tool or the apparatus 10 can be used as follows to repair a wallboard, such as wallboard 310. The apparatus 10 can be lined up in the cutting state. Then the end 20*b* can be hit multiple times with a hammer until the cutting end 200*a* goes through the wallboard 310 and hits the stud 320. This action causes a force in the direction D6 and causes the sharp end 200*a* to create a circular hole or bore hole 312 in the wallboard 310 around a popped nail, such as nail 300 as shown in FIG. 2B. (The apparatus 10 could also be rotated like a drill instead of hit like a hammer to create a bore hole in the wallboard 310). This action also structurally separates the wallboard 310 from the nail 300. Generally, there should be very little or no movement of the nail 300 during the cutting operation or movement.

The apparatus 10 can be removed from the wallboard 310 and from the stud 320. The cut wallboard 310 area can be cleaned out. The apparatus 10 can be replaced into the cut bore hole 312, still in the cuffing state, and the end 20*b* can be hit with a hammer (or use rotation) until the apparatus 10 is back into a full sunk position.

Apparatus 10 can then be rotated into driving state. The end 20*b* can be hit, while apparatus 10 is in a driving state with a hammer to drive the nail home. Apparatus 10 can be removed and the bore hole area blown clean. The tool or apparatus 10 can be removed after the initial cut to help clean some of the excess gypsum. This extra step may be eliminated, particularly if enough clearance is provided between the driving element or portion 38 and the cutting member 200 inner wall, to allow for the gypsum to be relocated. It may not be necessary to consciously line up 38*a* with nail 300, as shown in FIG. 1D, since this should be achieved automatically by ensuring the cutting member 200 surrounds the nail 300 evenly as shown in a transitional position of the driving state shown in FIG. 1E. At the time the tool on apparatus 10 is put in the driving state, such as in FIG. 1E, end 38*a* is typically hidden from sight within the cutting member 200 as shown in FIG. 1E, where 38*a* is shown in dashed lines to show that it is hidden and recessed within cutting member 200.

During this driving process the connecting member 200 provides a shield to prevent the wallboard 310 from being damaged. The end 38*a* may eventually extend outward one-sixteenth (1/16) of an inch beyond the cutting end 200*a* of the connecting member 200 in the state of FIGS. 1C and 1D, so that the nail 300 can be driven a short distance, or countersunk into the stud 320.

While the cutting state in one embodiment, means that the member 20 is fixed translationally with respect to the member 100, the driving state in one embodiment is allowed to move translationally. Referring to FIG. 1E shows the apparatus 10 in a driving state where the nail 300 has not been driven in yet. The member 20 and its portion 38 can move translationally while still in the driving state from the position in FIG. 1E to the position in FIG. 2C to drive the nail 300 in, as the end 20*b* is hit with a hammer or other impact tool.

Figure 2C:
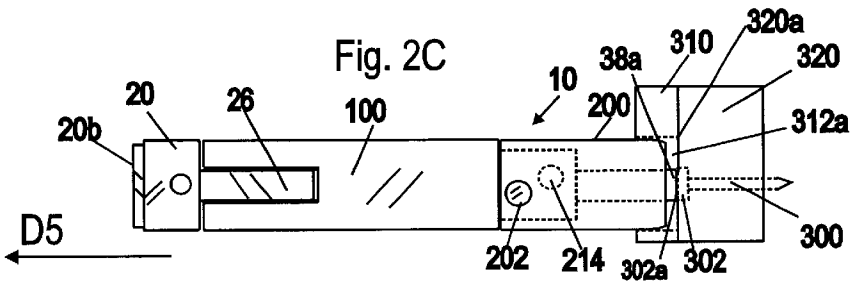
FIG. 2C shows a bottom view of the apparatus of FIG. 1C with the apparatus in the driving state at the translational position of FIG. 1D, after the apparatus has been used to drive the nail of FIG. 2A into the stud of FIG. 2A.

FIG. 2C shows the nail 300 after it has been driven into the stud 320. FIGS. 1D and 2C show an empty bore hole 312*a* where previously there was a wallboard portion 312. After the nail 300 has been drive into the stud 320 so that the top surface 320*a* of the stud 320 is about even or flush (in the countersunk example) with the top surface 302*a* of the nail head 302, the apparatus 10 can be removed leaving the bore hole 312*a*. The bore hole 312*a* can be filled as previously discussed with a plug and/or with spackling or patching compound, or some other compound.

Gypsum material in the bore hole 312 of the wallboard 310 is pulverized by the driving process. Much of this pulverized material is retained in the apparatus 10 to be tapped or blown clean before next use. Some material remaining in the bore hole 312*a* can also be blown or brushed clean. This secondary sequence creates a clean, consistent and even hole in the wallboard 310. The bore hole 312*a* is then filled with a plug and compound and the repair is complete. In extreme cases, where many repairs are necessary along the same stud, drywall screws can be used to re-secure the existing wallboard 310 to the stud 320.

Figure 6A:
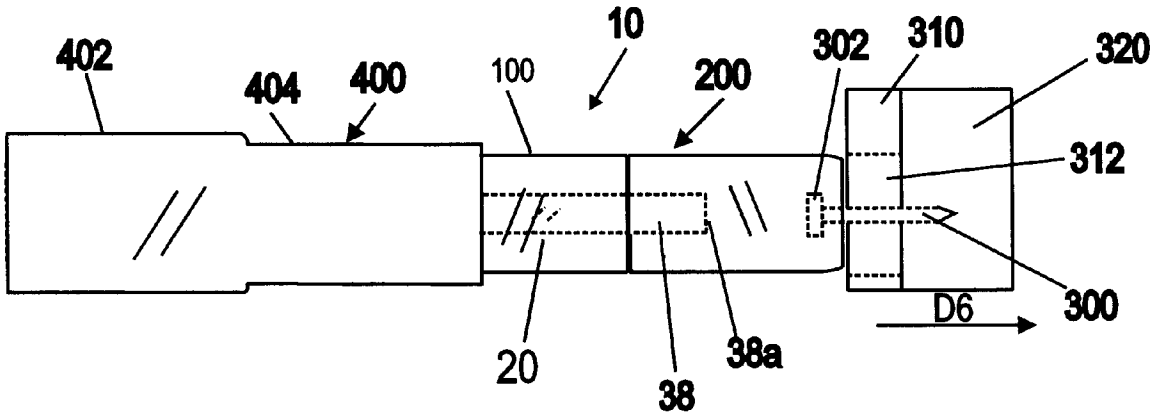
FIG. 6A shows the left side view of FIG. 1C with an additional optional handle attached to the apparatus 10 in a cutting state.

FIG. 6A shows the left side view of FIG. 1C with an additional optional handle 400 attached to the apparatus 10 in a cutting state. The handle 400 has a cylindrical portion 402 and a cylindrical portion 404 which are integrated together. The cylindrical portions 402 and 404 may have the same inner diameter which is large enough to insert a portion member 20 and a portion of member 100 as can be seen from FIGS. 6A and 1C. The cylindrical portions 402 and 404 may have different outer diameters, with the larger outer diameter of cylindrical portion 402 being used so that the handle 400 is easier to grab onto. Where in this application, an individual is directed to grab pull, push, or grab the member 20 or a portion of the member 20, the individual should pull, push or grab the optional handle 400 if it is attached to the apparatus 10 as shown in FIGS. 6A and 6B.

Figure 6B:
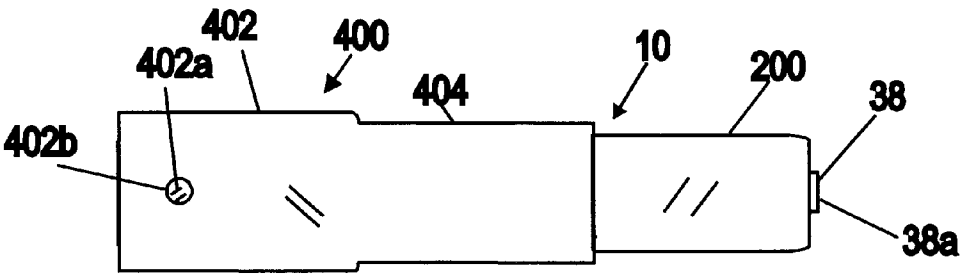
FIG. 6B shows a bottom view similar to FIG. 2A with the additional optional handle of FIG. 6A attached to the apparatus 10 in the driving state.

FIG. 6B shows a bottom view similar to FIG. 2A with the additional optional handle 400 of FIG. 6A attached to the apparatus 10 in the driving state. The handle 400 can be attached to the apparatus 10 and to the member 20 by a screw 402*b* which can be inserted into an opening 402*a* of the handle 400 and then into an opening 25*a* (see FIG. 3A) of the portion 25 of the member 20.

The present invention in one or more embodiments overcomes the failings of the prior art by eliminating the influence of the nail without damaging the drywall. This invention allows for the repair of nail pops without harm or catastrophic damage to the wallboard eliminating the need for labor intensive, costly replacement of the drywall.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. A method comprising the steps of:

finding a nail which has been nailed through a wallboard at a location and into a framing support but which has popped out so that a nail head of the nail lies substantially out of a plane of the wallboard;

separating the nail from the wallboard so that the nail is no longer structurally connected to the wallboard; and driving the nail into the framing support.

2. The method of claim 1 wherein the nail is driven so that the nail head becomes substantially flush with a surface of the framing support.

3. The method of claim 1 wherein the nail is driven so that the nail head is counter sunk below a surface of the framing support.

4. The method of claim 2 further comprising pacing an apparatus comprised of a cutting member and a driving device into a first state in which the driving is recessed into a cutting member;

using the apparatus in the first state to separate the nail from the wallboard by cutting an area of wallboard surrounding the nail;

placing the apparatus into a second state in which the driving device extends outward from the cutting member;

and using the apparatus in the second state to drive the nail into the framing support.

5. The method of claim 1 wherein the nail is separated from the wallboard by cutting out an area of the wallboard which surrounds the nail, while the nail is nailed into the framing support.

6. The method of claim 5 wherein the nail has a nail head and the area is larger than the nail head.

7. The method of claim 1 further comprising shielding the wallboard from the impact of driving the nail into the framing support by inserting a member into the wallboard, wherein the member surrounds the nail, and the member remains substantially stationary while the nail is being driven into the framing support.

8. The method of claim 1 further comprising placing an apparatus comprised of a cutting member and a driving device into a first state;

using the apparatus in the first state to separate the nail from the wallboard by cutting an area of the wallboard surrounding the nail;

placing the apparatus in a second state;

and using the apparatus in the second state to drive the nail into the framing support.

9. The method of claim 8 wherein the cutting member and the driving device are connected so that the cutting member can be slid with respect to the driving device to change the apparatus from the first state to the second state or from the second state to the first state.

10. A method comprising the steps of:

finding a nail which has been nailed through a wallboard at a location and into a framing support but which has popped out so that a nail head of the nail lies substantially out of a plane of the wallboard;

separating the nail from the wallboard so that the nail is no longer structurally connected to the wallboard; and wherein the nail is separated from the wallboard by cutting a hole into the wallboard around the location where the nail was nailed through the wallboard.

11. The method of claim 10 further comprising pulling the nail out of the framing support.

12. The method of claim 11 further comprising filling the hole after the nail has been pulled out of the framing support.

13. The method of claim 10 further comprising driving the nail into the framing support; and filling the hole after the nail has been driven into the framing support.

14. The method of claim 10 wherein the step of cutting around the nail is achieved through impact.

15. The method of claim 10 wherein the step of cutting around the nail is achieved through rotational energy.

16. The method of claim 4 wherein the step of filling the hole is achieved by filling the hole with material.

17. The method of claim 11 wherein the material is a spackling compound.

18. The method of claim 4 wherein the step of filling the hole is achieved by filling the hole with a plug.

19. The method of claim 4 wherein the step of filling the hole is achieved by filling the hole with a plug and a material.

20. The method of claim 10 wherein the nail is separated from the wallboard by cutting out an area of the wallboard which surrounds the nail, while the nail is nailed into the framing support.

* * * * *

UNITED STATES PATENT AND TRADEMARK OFFICE

CERTIFICATE OF CORRECTION

PATENT NO. : 6,755,002 B2
APPLICATION NO. : 10/012883
DATED : June 29, 2004
INVENTOR(S) : Pendrous et al.

It is certified that error appears in the above-identified patent and that said Letters Patent is hereby corrected as shown below:

Col. 11, line 9:

In claim 1, last line: after "driving the nail into the framing support" and before period should be:

-- wherein the nail is separated from the wallboard by cutting a bore hole into the wallboard around the location where the nail was nailed through the wallboard --;

Col. 11, line 17,

In claim 4, 1st line: "2" should be replaced with -- 1 --;

Col. 11, line 18,

In claim 4, 2nd line: "pacing" should be replaced by -- placing --;

Col. 11, line 19,

In claim 4, 3rd line: "driving" should be replaced by -- driving device --;

Col. 12, line 35,

In claim 16, 1st line: "4" should be replaced with -- 13 --;

Col. 12, line 38,

In claim 17, 1st line: "11" should be replace with -- 16 --;

UNITED STATES PATENT AND TRADEMARK OFFICE

CERTIFICATE OF CORRECTION

PATENT NO. : 6,755,002 B2
APPLICATION NO. : 10/012883
DATED : June 29, 2004
INVENTOR(S) : Pendrous et al.

It is certified that error appears in the above-identified patent and that said Letters Patent is hereby corrected as shown below:

Col. 12, line 40,

In claim 18, 1st line: "4" should be replaced with -- 13 --; and

Col. 12, line 43,

In claim 19, 1st line: "4" should be replaced with -- 13 --.

Signed and Sealed this

Sixteenth Day of September, 2008

JON W. DUDAS
*Director of the United States Patent and Trademark Office*